US011589665B2

(12) United States Patent
Nakamura

(10) Patent No.: US 11,589,665 B2
(45) Date of Patent: Feb. 28, 2023

(54) COSMETIC APPLICATOR

(71) Applicant: MITSUBISHI PENCIL COMPANY, LIMITED, Tokyo (JP)

(72) Inventor: Yusuke Nakamura, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 17/423,037

(22) PCT Filed: Jan. 21, 2020

(86) PCT No.: PCT/JP2020/001938
§ 371 (c)(1),
(2) Date: Jul. 14, 2021

(87) PCT Pub. No.: WO2020/153351
PCT Pub. Date: Jul. 30, 2020

(65) Prior Publication Data

US 2022/0061496 A1 Mar. 3, 2022

(30) Foreign Application Priority Data

Jan. 23, 2019 (JP) ..... JP2019-009131

(51) Int. Cl.
*A45D 34/04* (2006.01)
*B43K 8/03* (2006.01)
(Continued)

(52) U.S. Cl.
CPC ..... *A45D 34/04* (2013.01); *B43K 8/03* (2013.01); *B43K 23/128* (2013.01); *B43K 23/08* (2013.01); *B43K 23/12* (2013.01)

(58) Field of Classification Search
CPC ..... A45D 34/04; A45D 40/26; A45D 34/00; B43K 8/03; B43K 5/005; B43K 23/00; B43K 23/08; B43K 23/12; B43K 23/128
(Continued)

(56) References Cited

U.S. PATENT DOCUMENTS 431,250 A * 7/1890 Cliff
2,488,179 A 11/1949 Engel
(Continued)

FOREIGN PATENT DOCUMENTS

CN 2565631 Y 8/2003
CN 206238699 U 6/2017
(Continued)

OTHER PUBLICATIONS

International Search Report for corresponding Application No. PCT/JP2020/001938, dated Mar. 24, 2020.
(Continued)

*Primary Examiner* — David J Walczak
(74) *Attorney, Agent, or Firm* — Renner, Otto, Boisselle & Sklar, LLP

(57) ABSTRACT

A cosmetic applicator that can alleviate the shock at its barrel cylinder even if the center of gravity of the applicator is on the rear side. In the cosmetic applicator having an applying part provided at the front end of the barrel cylinder and a cosmetic stored in the rear of the barrel cylinder, a resilient member is mounted to the rear end of the barrel cylinder.

3 Claims, 6 Drawing Sheets

(51) Int. Cl.
*B43K 23/12* (2006.01)
*B43K 23/08* (2006.01)

(58) Field of Classification Search
USPC ..... 401/103; 267/286–290, 166–168
See application file for complete search history.

(56) References Cited

U.S. PATENT DOCUMENTS

| | | | | |
|---|---|---|---|---|
| 4,111,407 | A * | 9/1978 | Stager | F16F 1/08 267/166.1 |
| 6,261,015 | B1 * | 7/2001 | McCauley | B43K 24/02 401/116 |
| 7,959,368 | B2 * | 6/2011 | Sheu | B43K 23/128 401/103 |
| 11,051,631 | B2 * | 7/2021 | DeMoss | F16F 3/04 |
| 2010/0065996 | A1 * | 3/2010 | Hohl | F16F 3/04 267/168 |

FOREIGN PATENT DOCUMENTS

| | | | |
|---|---|---|---|
| EP | 2987644 | A1 | 2/2016 |
| JP | 47-38487 | Y1 | 11/1972 |
| JP | 63-40504 | A | 2/1988 |
| JP | 2007-176110 | A | 7/2007 |
| JP | 2018-192242 | A | 12/2018 |
| JP | 2018-192794 | A | 12/2018 |

OTHER PUBLICATIONS

Extended European Search Report corresponding with Application European Application No. 20744827.5 dated Aug. 21, 2022.

* cited by examiner

[Fig.1]
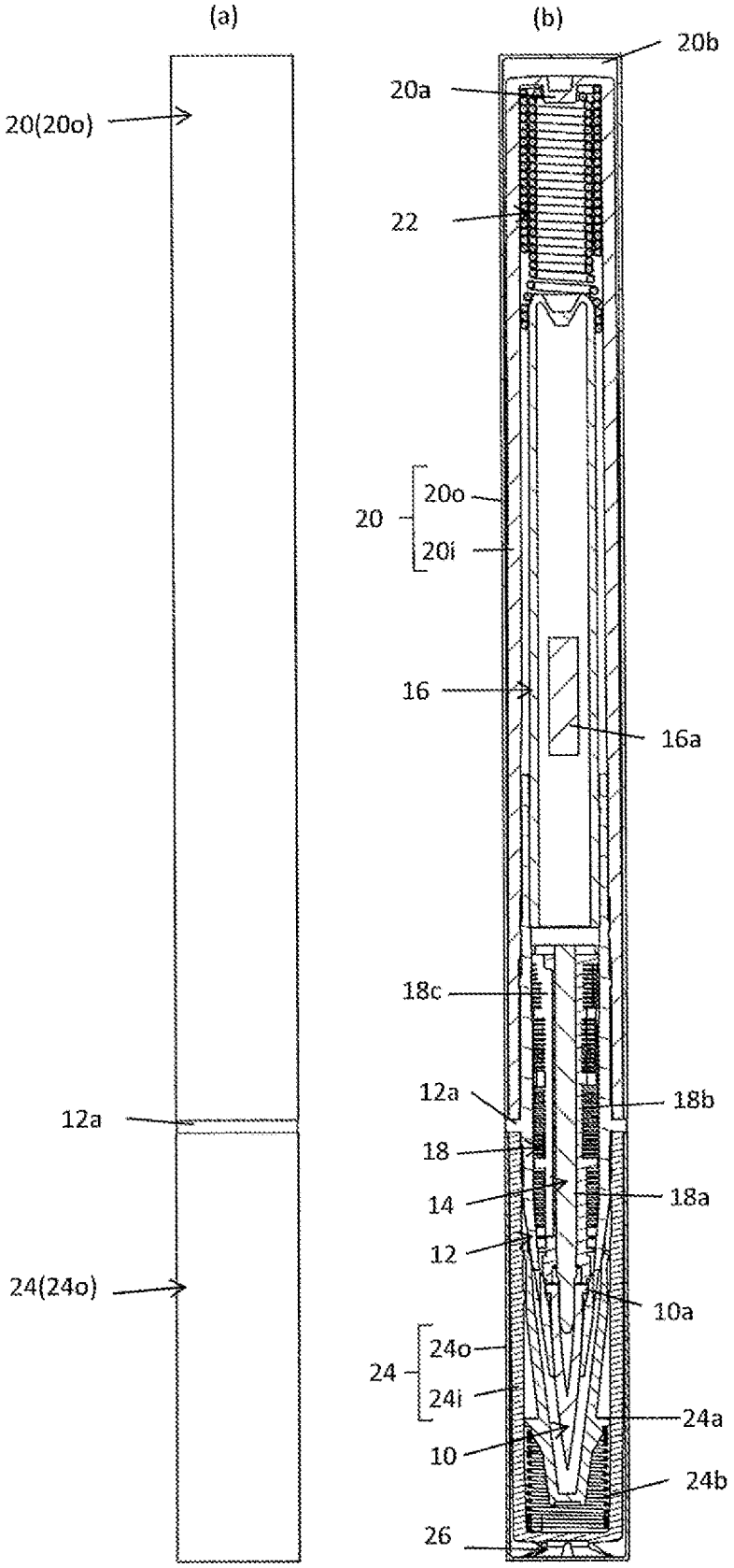

[Fig.2]
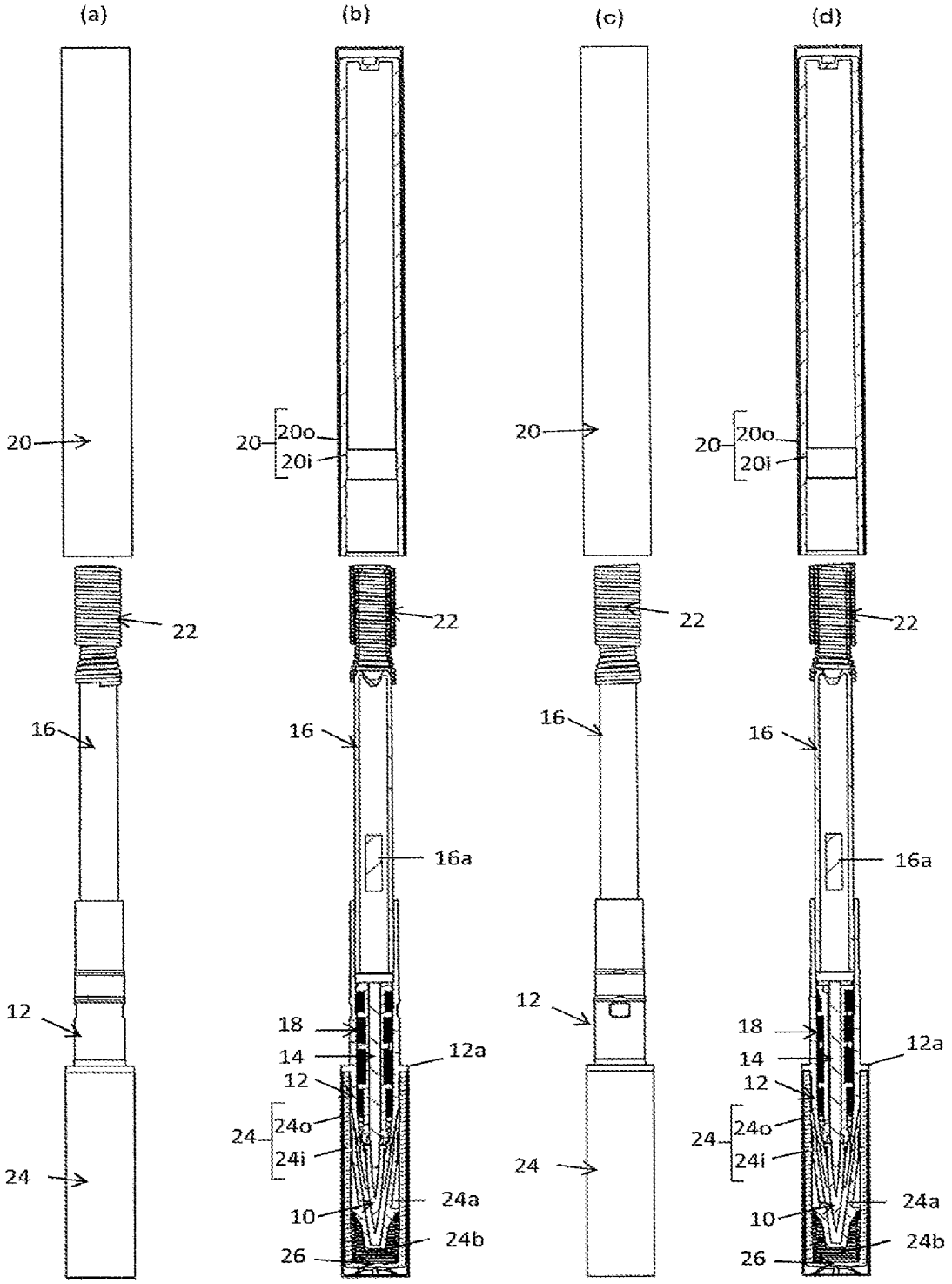

[Fig.3]
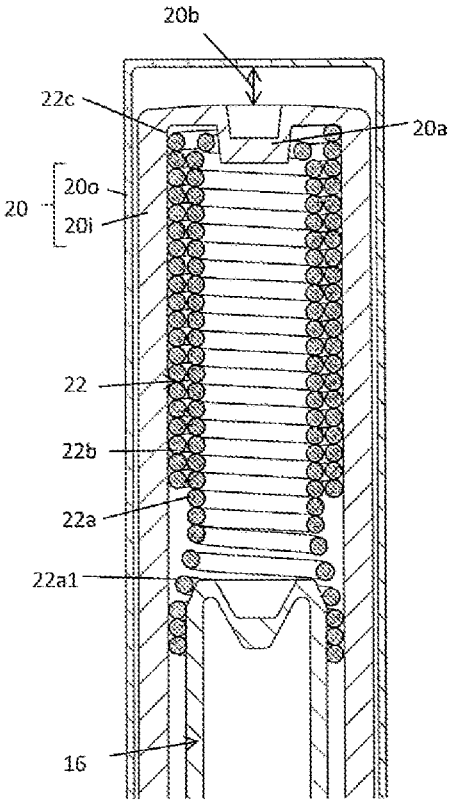

[Fig.4]
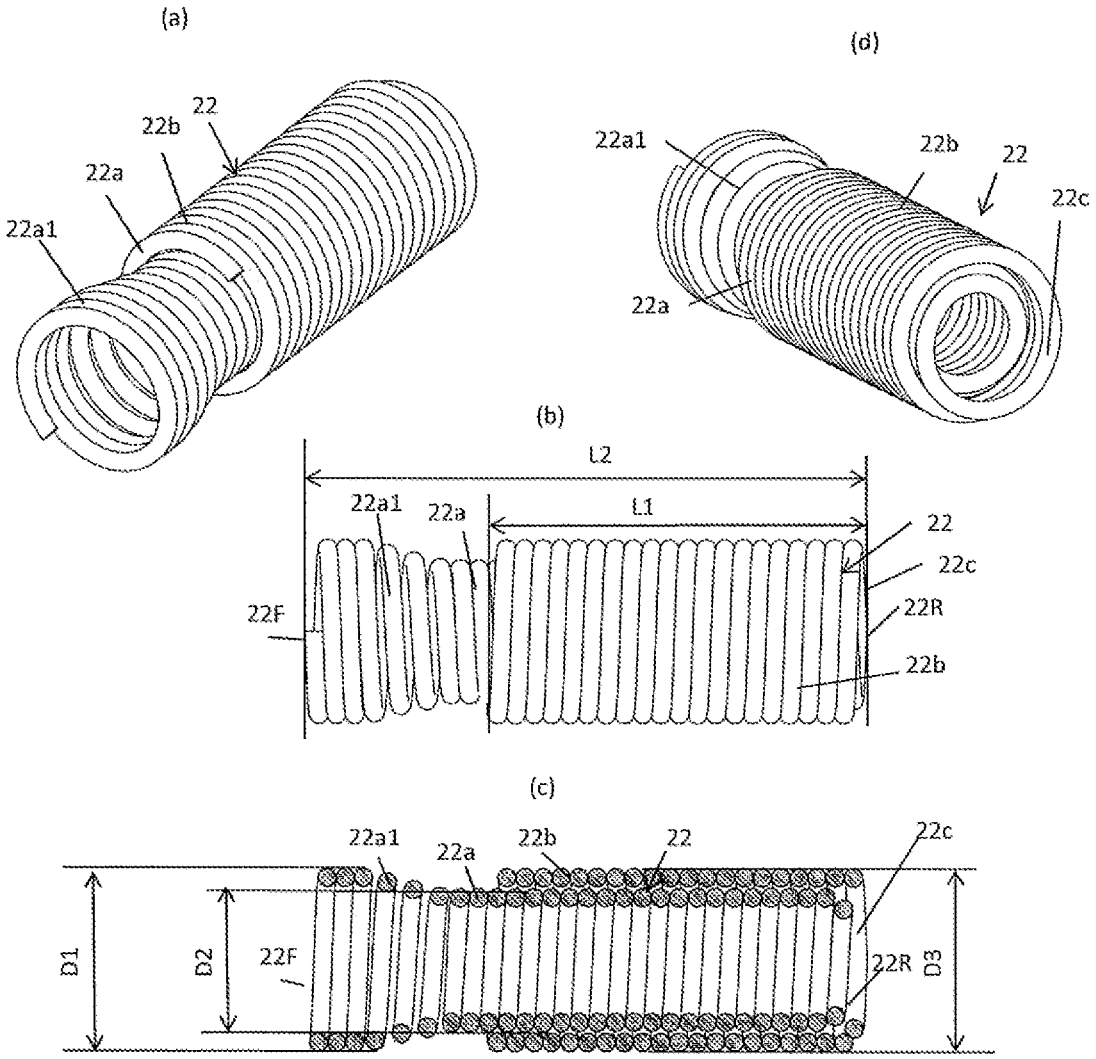

[Fig.5]
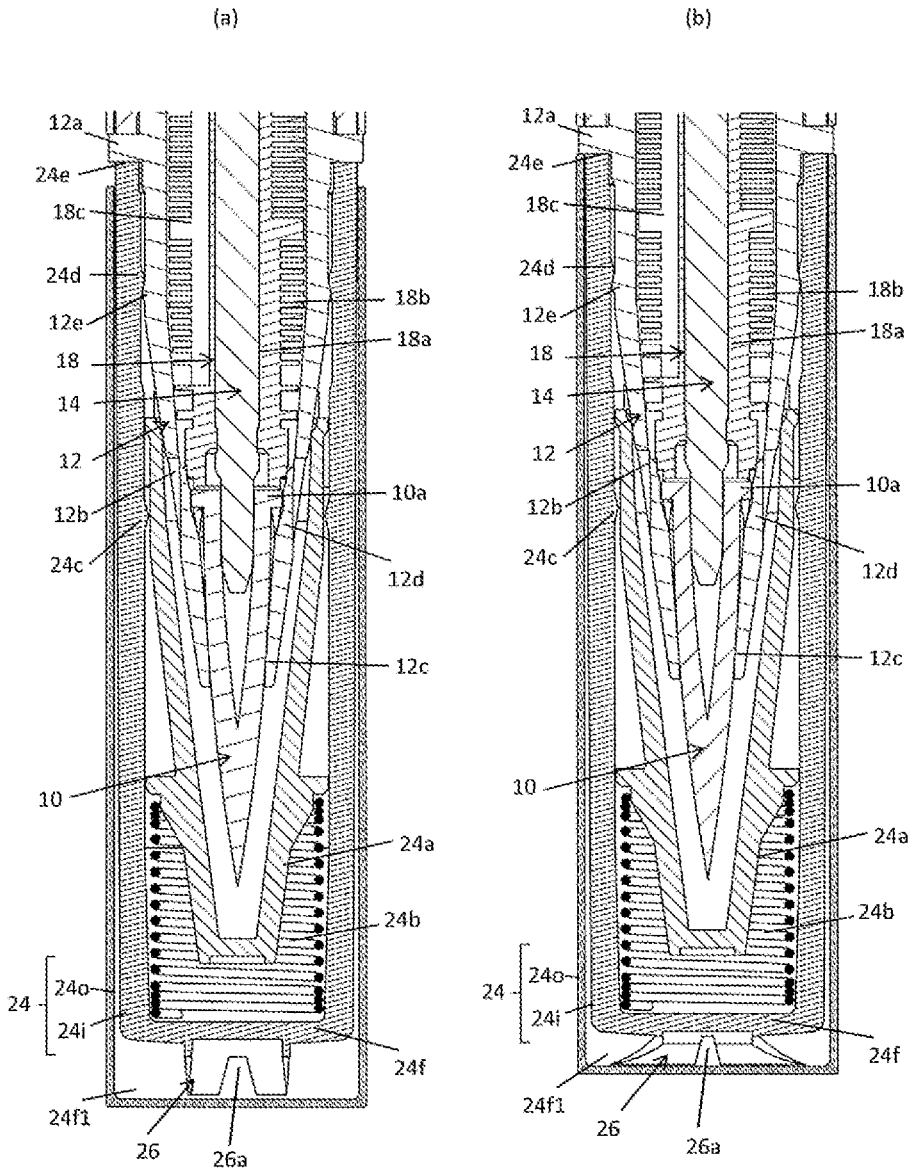

[Fig.6]
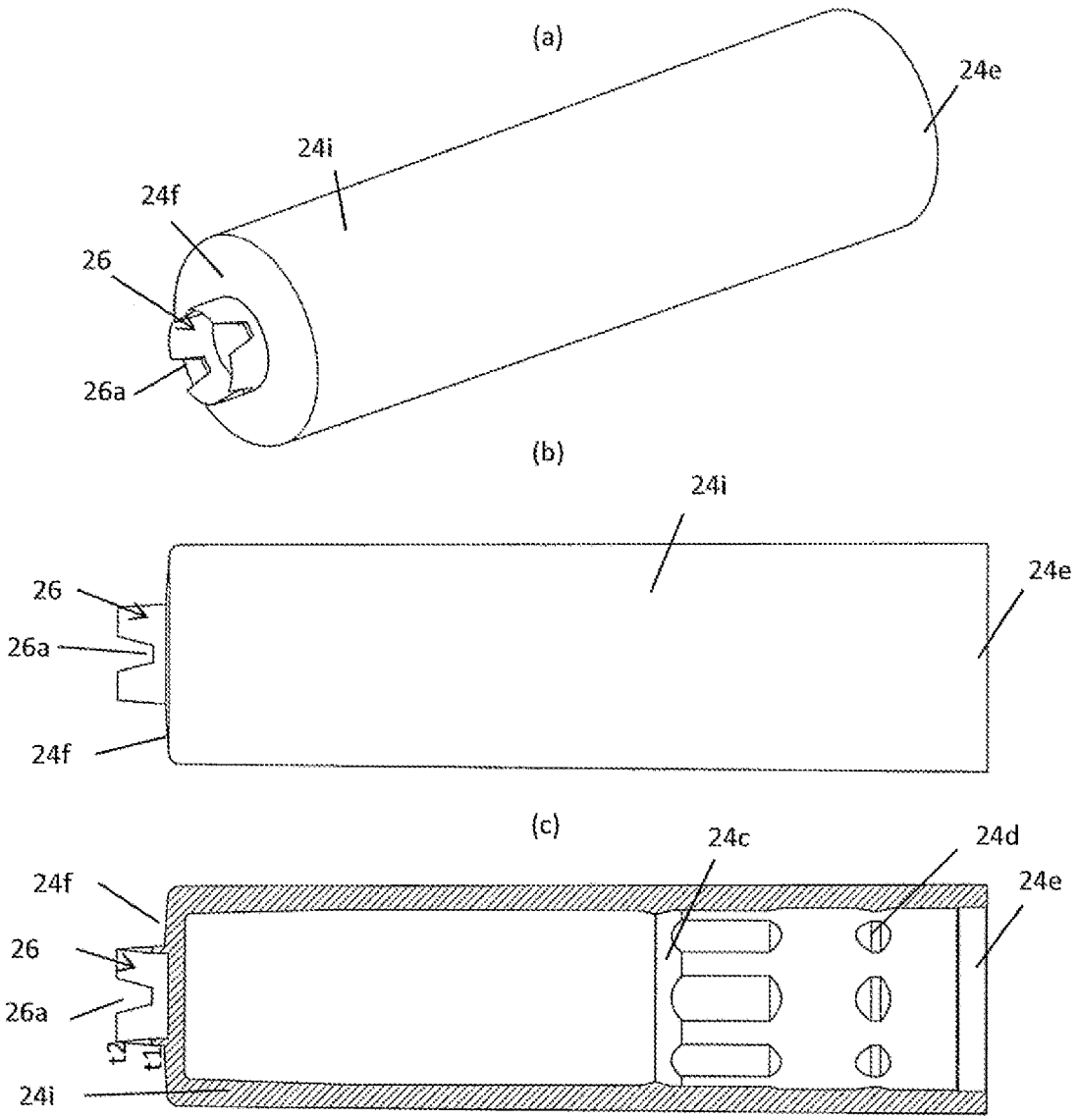

COSMETIC APPLICATOR

TECHNICAL FIELD

The present invention relates to an applicator as a cosmetic tool for applying a cosmetic liquid.

BACKGROUND ART

Conventionally, Patent Document 1 has disclosed a cosmetic applicator for applying cosmetics to the face and the like during makeup. This applicator has heavy parts disposed in the rear portion of its barrel so as to put the center of gravity of the applicator in the rear side with respect to the axial direction, whereby the applying part can be easily oriented upward during application, making it easy to apply on the eyes and the like.

PRIOR ART DOCUMENTS

Patent Documents

Patent Document 1

Japanese Patent Application Laid-Open No. 2018-192794

SUMMARY OF THE INVENTION

Problems to be Solved by the Invention

However, since the above-described cosmetic applicator has heavy parts arranged in the rear part of the barrel cylinder in order to place the center of gravity on the rear side, there is a risk that the rear portion of the barrel is damaged when the applicator is dropped, due to increased mass of the applicator. In addition, the cosmetic liquid stored in the barrel may leak out due to breakage.

It is therefore an object of the present invention to provide a cosmetic applicator capable of alleviating the shock on the barrel cylinder when a shock acts on the applicator.

Means for Solving Problems

The present invention is a cosmetic applicator in which an applying part is provided at the front end of a barrel cylinder and a cosmetic is stored in the rear of the barrel cylinder, characterized in that a resilient member is mounted to the rear end of the barrel cylinder.

Effect of the Invention

According to the present invention, provision of a resilient member on the rear side of the barrel cylinder enables the resilient member to absorb the shock acting on the applicator when it is dropped.

BRIEF DESCRIPTION OF DRAWINGS

FIG. 1 Overall views of a cosmetic applicator according to an embodiment of the present invention, (a) an external view, and (b) a vertical sectional view.

FIG. 2 Overall views of the cosmetic applicator in a state before assembling a cap, (a) an external view, (b) a vertical sectional view, (c) an external view rotated 90° from (a), and (d) a vertical sectional view in the same state as (c).

FIG. 3 An illustrative view of a rear end portion of the cosmetic applicator provided with a resilient member (spring).

FIG. 4 Component diagrams of a resilient member of the cosmetic applicator, (a) a perspective view from the front, (b) a side view, (c) a vertical sectional view, and (d) a perspective view of the rear.

FIG. 5 Illustrative views of a front end portion of the barrel of the cosmetic applicator, (a) a vertical sectional view before cap assembly, and (b) a vertical sectional view after cap assembly.

FIG. 6 Illustrative views of the interior of the cap of the cosmetic applicator, (a) a perspective view from the front, (b) a side view, and (c) a vertical sectional view.

MODES FOR CARRYING OUT THE INVENTION

An embodiment of the present invention will be described with reference to FIGS. 1 to 6 of the drawings.

FIG. 1 is an overall view of a cosmetic applicator according to the embodiment, FIG. 2 is an overall view of the cosmetic applicator in a state before cap assembling, FIG. 3 is an illustrative view of the rear end portion of the cosmetic applicator, FIG. 4 is a component diagram of a resilient member, FIG. 5 is an illustrative view of the front end portion of a barrel of the cosmetic applicator, and FIG. 6 is an illustrative diagram of the interior of the cap.

As shown in FIG. 1, the cosmetic applicator is constructed such that an applying part 10 is provided at the front end portion of a barrel cylinder while a cosmetic is stored in a liquid storage 16 in the rear part of the barrel cylinder (a front barrel 12, a rear barrel 20, the liquid storage 16, etc.). Provided on the rear side of the liquid storage 16 is a resilient member 22. A cap 24 (an interior part 24*i* and an exterior part 24*o*) includes a bending part 26 in the interior part 24*i*. The parts in the overall view in a state before assembly of the cosmetic applicator shown in FIG. 2 are allotted with the same reference numerals to the identical parts in FIG. 1.

As shown in FIG. 1, in this cosmetic applicator, the applying part 10 is provided in the front end portion inside the front barrel 12, and a collector 18 is provided in contact with the rear end of the applying part 10. A relay core 14 is provided inside the collector 18. A rear barrel 20 is fitted on the outer circumference of the rear part of the front barrel 12. The front barrel 12 and the rear barrel 20 form the external configuration of the barrel cylinder. The removable cap 24 is provided on the outer circumference of the front barrel 12 to cover the applying part 10 when the applicator is not in use. The liquid storage 16 and the resilient member 22 are provided in the rear portion of the rear barrel 20.

In this cosmetic applicator, the applying part 10 is set inside the front barrel 12 on the front end side of the barrel cylinder, and the cosmetic is stored in the liquid storage 16 set on the rear end side of the front barrel 12. At the rear end of the barrel cylinder, the resilient member 22 mounted to the rear end of the liquid storage 16 is arranged inside the rear barrel 20.

The resilient member 22 is made of metal and is double wound to have a weight, and functions as a weight that puts the center of gravity in the axial direction on the rear side of the applicator.

The liquid storage 16 for storing liquid cosmetic is set behind the collector 18 in the front barrel 12. A flange 12*a* expands in diameter on the outer circumference of the front barrel 12. A cap 24 abuts the front face of the flange 12*a*, while the front end of the rear barrel 20 abuts the rear face of the flange 12*a*. The exterior part 24*o* is arranged to cover the periphery of the interior part 24*i* of the cap 24.

The relay core 14 feeds the liquid cosmetic to the applying part 10. In the cosmetic applicator, the tip of the applying part 10 in the front barrel 12 protrudes and is exposed from a mouth 12*c* (see FIG. 5) at the front end of the front barrel 12. The inner peripheral surface of the mouth 12*c* of the front barrel 12 is in contact with the periphery of the applying part 10. Further, in the front barrel 12, the tip of the relay core 14 inside the collector 18 comes in contact with the rear end face of the applying part 10 to feed the cosmetic. The collector 18 has an application liquid feed groove (slit) 18*c* through which the application liquid is supplied from the relay core 14 to the applying part 10. It should be noted that in the collector 18, the relay core 14 may have a feed structure with an application liquid feed groove formed therewith.

A more specific configuration will be explained.

As shown in FIG. 1, in the cosmetic applicator according to the embodiment, the rear end portion of the applying part 10 has a hollow therein and a flange 10*a* formed with an enlarged diameter on the periphery thereof. The front end part of the applying part 10 is formed inside the front barrel 12 so as to protrude from the top mouth of the front barrel 12.

A collector 18 having a function of temporarily retaining the liquid between multiple fins is arranged inside the front barrel 12. The flange 10*a* is pressed by the front end of the collector 18 and fixed inside the front barrel 12. The relay core 14 inside a hollow hole 18*a* of the collector 18 has a structure that feeds the liquid cosmetic in the liquid storage 16 to the applying part 10.

The liquid storage 16 is fixed in the rear part of the front barrel 12 by fitting its tip therein.

[Collector 18]

As shown in FIG. 1, the hollow hole 18*a* is formed along the axial direction through the inside of the collector 18, from its front to rear end, while the relay core 14 is set in the hollow hole 18*a*.

As partly shown in FIG. 5, multiple fins 18*b* are arranged at intervals on the periphery of the collector 18. The fins 18*b* provides the function of the collector 18 that temporarily retains the liquid therebetween by their capillary force.

A slit 18*c* is formed so as to cut the fins 18*b* in the vertical direction (axial direction). The collector 18 allows the liquid cosmetic to flow in and out between the fins 18*b* through the slit 18*c*.

Further, ribs may be formed in the hollow hole 18*a* so as to hold the relay core 14 therewith.

The collector 18 is set inside the front barrel 12 so that the hollow hole 18*a* and the slit 18*c* on the rear end side of the collector 18 oppose the opening in the front part of the liquid storage 16 (see FIG. 1).

The rear end face (rear end portion) of the relay core 14 set in the hollow hole 18*a* of the collector 18 is exposed to the liquid storage 16 so that the relay core 14 feeds the liquid (liquid cosmetic) forward (toward the applying part 10) from the liquid storage 16.

As shown in FIG. 5, the collector 18 has a cup-shaped front and is positioned with the front part of the cup fitted and fixed into a step portion 12*d* fainted inside the front barrel 12. Further, the cup-shaped front end of the collector 18 presses the rear end portion (the rear endface of the flange 10*a*) of the applying part 10. The tip of the relay core 14 in the collector 18 is inserted in the rear end hollow of the applying part 10. The rear end portion of the collector 18 is exposed toward the liquid storage 16, and when the internal pressure in the liquid storage 16 rises due to a change in atmospheric pressure, temperature and/or the like, the application liquid in the liquid storage 16 passes through the slit 18*c* and stored between the fins 18*b* of the collector 18. A vent hole 12*b* for venting between the inside and outside of the collector 18 for gas-liquid replacement is formed in the front barrel 12.

Outside air flows from the vent hole 12*b* into the interior of the front barrel 12, and therefore reaches the fins 18*b* and the slit 18*c* on the periphery of the collector 18 housed in the front barrel 12. Even if the internal pressure of the liquid storage 16 fluctuates, the venting inside the front barrel 12 alleviates the change in internal pressure and prevents blowout of the application liquid from the applying part 10 or intermittence of the application liquid and the like.

[Liquid Storage 16] As shown in FIGS. 1 and 2, the liquid storage 16 is arranged so that its front portion is fitted into the rear part of the front barrel 12 (rear of the flange 12*a*), and the rear part of the collector 18 set in the front barrel 12 is adjacent to the interior of the front portion of the liquid storage 16. Accommodated in the liquid storage 16 is a stirring body 16*a* made of resin or metal, having a rod-shape (or spherical shape, etc. as appropriate) for stirring the liquid.

[Front Barrel 12]

As shown in FIGS. 1 and 2, the front barrel 12 is a resin item having a tubular hollowed structure as a whole with its front part tapered to the front and its rear part formed pipe-like, substantially uniform in diameter.

The front barrel 12 is foamed of a front part to which the cap 24 is detachably fitted and a rear part on which the rear barrel 20 is externally fitted. The flange 12*a* is formed so as to protrude radially outward on the outer circumferential surface at the boundary between the front part and the rear part.

FIG. 5 shows the front end side of the front barrel 12. The front barrel 12 is constructed such that the interior of the front part shrinks angularly step-wise in diameter (foaming a step portion 12*d*), while a plurality of vent holes 12*b*, which are openings extending in a nearly axial direction, are formed circumferentially adjacent to and behind the step portion 12*d* having small diameter.

The diameter of the front barrel 12 is reduced stepwise at the step portion 12*d* on the inner surface of the portion where the rear portion of the applying part 10 and the front end of the collector 18 are located. The section ahead of the step portion 12*d* forms the mouth 12*c* whose inner surface is reducing in diameter, and the applying part 10 is set inside the mouth 12*c*. In the front barrel 12, the inner diameter of the front end of the mouth 12*c* is formed to be the smallest from the front to rear parts.

Further, the areas adjacent to the vent holes 12*b* inside the front part of the front barrel 12 are connected to the step portion 12*d* at a reduced diameter. Fitted and fixed to the step portion 12*d* is the front end of the collector 18. Further, the inner surface of the front barrel 12 ahead of the step portion 12*d* is gently tapered, or reduced in diameter.

The rear part of the front barrel 12 is formed in a substantially cylindrical shape, and has the flange 12*a* of enlarged diameter foamed on the periphery thereof. The front barrel 12 is fixed with its rear part behind the flange 12*a* inserted into the front end portion of the rear barrel 20 (see FIG. 1). When the front barrel 12 is attached to the rear barrel 20, the flange 12*a* abuts the front end of the rear barrel 20 so that the front barrel 12 will not sink into the rear barrel 20.

Additionally formed on the periphery of the front barrel 12 behind the flange 12*a* are multiple projections and indentations so that the rear barrel 20 is fitted and held without coming off. Projections and indentations are also famed on the inner circumferential portion of the rear barrel 20, corresponding to the former projections and indentations, so that the former and the latter mate with each other, creating liquid tightness and prevent detachment.

[Rear Barrel 20]

As shown in FIGS. 1 and 3, the rear barrel 20 covers the liquid storage 16. The liquid storage 16 as a cosmetic tank, being fitted inside the rear part of the front barrel 12, is covered by the rear barrel 20. The resilient member 22 is arranged inside the rear end portion of the rear barrel 20, with its front end part externally fitted on the rear end of the liquid storage 16.

[Resilient Member 22]

As shown in FIGS. 1 and 3, the resilient member 22 is arranged inside the rear barrel 20.

The rear barrel 20 has a protrusion 20*a* that projects forward from the inside of the rear end portion (the inside of an interior part 20*i*). As will be described in detail later, the rear barrel 20 has a double structure in which an exterior part 20*o* is mounted on the outside of the interior part 20*i*. At the rear end of the rear barrel 20, a void (clearance) 20*b* is formed between the outside of the interior part 20*i* and the inside of the exterior part 20*o*.

The barrel cylinder includes the rear barrel (corresponding to the "outer barrel") 20, the liquid storage (corresponding to the "inner barrel") 16 housed inside the rear barrel 20, and the resilient member 22 mounted to the rear end of the liquid storage (inner barrel) 16.

As shown in FIG. 3, a tapered portion 22*a*1 in the front end of the resilient member 22 is fitted so as to clasp the rear end of the liquid storage 16. The periphery of the tapered portion 22*a*1 is in contact with the inner circumferential surface of the rear barrel 20.

The resilient member 22 includes a double-wound wire in the rear end portion thereof where an inner winding portion 22*a* is slightly constricted in inner diameter and fitted on the protrusion 20*a*. The periphery of an outer winding portion 22*b* is in sliding contact with the inner circumferential surface of the rear barrel 20.

As shown in FIG. 4, the resilient member 22 is made of a single metal wire. In FIGS. 4(*b*) and 4(*c*), the front end (the first end) of the resilient member 22 is denoted by a reference numeral 22F, and the rear end (the second end) is denoted by a reference numeral 22R.

As shown in FIG. 4, the resilient member 22 is a double-wound wire in which the single-wound, inner winding portion 22*a* and the single-wound, outer winding portion 22*b* are joined on the rear side, foiling a substantially tubular shape. Comparing their lengths in the axial direction, the length (L1) of the outer winding portion 22*b* is shorter than the length (L2) of the inner winding portion 22*a*. The outer winding portion 22*b* is at least a half of, or greater than, the length of the inner winding portion 22*a*.

The resilient member 22 includes the single-wound tapered portion 22*a*1 at the first end (front end 22F) and a double-wound portion at the second end (rear end 22R). The resilient member 22 is a double-wound coil spring (spring) having the inner winding portion 22*a* and the outer winding portion 22*b* on the second end side. The inner winding portion 22*a* and the outer winding portion 22*b* are formed of a single wire continuously on the second end side (at a continuous portion 22*c*).

The wire is configured to be wound clockwise in the inner winding portion 22*a* as it advances from the front end 22F to the rear end 22R, made greater in diameter in the continuous portion 22*c* at the rear end 22R, and then wound counterclockwise in the outer winding portion 22*b* as it advances toward the front end 22F.

The inner winding portion 22*a* has the single-wound, tapered portion 22*a*1 on the front side. The outside diameter of the tapered portion 22*a*1 becomes smaller from the outside diameter D1 at the front end (the first end) as it goes toward the rear side (the second end side). The outside diameter D2 of the inner winding portion 22*a* located inside the front end (on the first end side) of the outer winding portion 22*b* is smaller than the outside diameter D1 of the front end (D1>D2). The outside diameter D1 of the inner winding portion 22*a* is substantially equal to or greater than the outside diameter D3 of the front end of the outer winding portion 22*b* (D1≠D3 or D1>D3). The tapered portion 22*a*1 has a shape in which the rear end is constricted in a substantially tapered shape as compared with the front end, i.e., a substantially pot-like shape.

Thus, the resilient member 22 is accommodated in the rear barrel 20 and used as a weight.

By fainting the resilient member 22 into a double-wound structure, the function as a weight can be enhanced as compared with a single-wound structure. The portion where elasticity is to be given is formed with the single-wound, tapered portion 22*a*1 so as to be able to absorb the variation of the dimension between the liquid storage portion (inner barrel) 16 and the rear barrel (outer barrel) 20. The wire is folded back at the portion where the wire can come into contact with the endface (inner endface) of the rear barrel, and no sharp point is fainted. Therefore, the rear barrel 20 is unlikely to be damaged.

From the above, the resilient member 22, thanks to its elastic force, can absorb the dimensional variation between the liquid storage 16 and the rear barrel 20. Therefore, the resilient member 22 can function as not only a weight but also realize the function of absorbing the dimensional variation between the components at a low cost. Thus, enhanced workability and cost reduction are achieved.

[Cap 24]

As shown in FIGS. 1 and 5, the cap 24 that covers the applying part 10 to the front barrel 12 when the applicator is not in use is configured such that an inner cap 24*a* airtightly contacts the rear slope of the vent holes 12*b* on the outer surface of the front barrel 12. In the main body (interior part 24*i*) forming the outer wall of the cap 24, the inner cap 24*a* is stressed backward by a spring 24*b*. The main body of the cap 24 is fitted on the front barrel 12, abutting the flange 12*a*.

The cap 24 has a double structure having the interior part 24*i* and the exterior part 24*o*.

As shown in FIG. 5, an engagement rib 24*c* is formed annularly on the inner surface of the interior part 24*i*, and abuts on, and comes into sliding contact with, the outside circumferential surface of the inner cap 24*a* while keeping airtightness to prevent the rattling of the inner cap 24*a* and the applying part 10 from drying.

Further, a projected portion 24*d* for fixing is formed near the rear end of the interior part 24*i*. The projected portion 24*d* is fitted with a concavo-convex portion 12*e* on the peripheral surface of the front barrel 12 so that the cap 24 can be prevented from coming off from the front barrel 12. The rear end portion, designated at 24*e*, of the interior part 24*i* abuts against the flange 12*a*, so that closure of the cap 24 is completed.

Further, the front barrel 12, the liquid storage 16, the rear barrel 20, the cap 24 and the like can be formed of a liquid-tight material, e.g., for example, various resin materials such as polyethylene, polypropylene and ABS. In the rear barrel 20 and the cap 24, the interior parts 20*i* and 22*i* are made of resin, but the exterior parts 20*o* and 24*o* are made of metal such as various alloys inclusive of aluminum, duralumin, and ceramic. The detailed structure is as follows.

[Double-Structured Rear Barrel 20 and Cap 24]

As shown in FIGS. 1 and 3, the rear barrel 20 has a double structure in which the exterior part 20*o* is mounted on the outside of the interior part 20*i*. The interior part 20*i* is made of resin as described above, whereas the exterior part 20*o* is made of metal.

The cap 24 has a double structure in which the exterior part 24*o* is mounted on the outside of the interior part 24*i*, and the interior part 24*i* is made of resin as described above, and the exterior part 24*o* is made of metal.

Because the two parts are formed of different materials, the coefficients of thermal expansion differ between the interior part 20*i* and the exterior part 20*o* in the rear barrel 20, and the coefficients of thermal expansion differ between the interior part 24*i* and the exterior part 24*o* in the cap 24.

Regarding the rear barrel 20, as shown in FIG. 3, the void (clearance) 20*b* is created (provided) in the rear end of the rear barrel 20 between the outside of the interior part 20*i* and the inside of the exterior part 20*o*. Provision of the void 20*b* can absorb the deformation of the rear barrel 20 caused by the interference between the interior part 20*i* and the exterior part 20*o* attributed to their different amounts of thermal deformation resulting from difference in material when the interior part 20*i* and the exterior part 20*o* expand thermally. The void 20*b* can also absorb dimensional variation during manufacturing and a shock when the applicator is dropped.

In order to cope with a case where the dimensions (size) vary between the cap 24, the interior part 24*i* and the exterior part 24*o*, the bending part 26 is formed at the front end of the interior part 24*i* so as to protrude, as shown in FIG. 5.

The bending part 26 is famed on the top surface of the cap 24 (interior part 24*i*) having a seal. The seal is the annular projected portion 24*d* formed on the inner circumferential surface in the rear end portion of the inner cap 24*a*. The projected portion 24*d* airtightly abuts the peripheral surface of the front barrel 12 to prevent the applying part 10 from drying.

Detailedly, as shown in FIG. 6, the interior part 24*i* has a tubular shape with a top surface 24*f* closed in the front portion. Projected on the top surface 24*f* is the tubular bending part 26 having a plurality of cutouts 26*a*. The bending part 26 is formed to be thinner as it projects forward. The outside diameter of the bending part 26 is expanded and reversely tapered as it goes rearward in the axial direction from the top, while the inner diameter is reduced and tapered. The cross-section of the bending part increases as it goes to the rear in the axial direction. That is, the bending part is thin at the top and becomes thicker (t1>t2) and unlikely to be bent with increased rigidity as it goes toward the top surface 24*f*.

FIG. 5(*a*) is an illustrative view showing a state before cap assembly, and FIG. 5(*b*) shows a state after cap assembly.

As shown in FIG. 5 (*a*), the bending part 26 is not pressed and stands upright before the cap is assembled and on the way while the interior part 24*i* is being covered with the exterior part 24*o*.

When the interior part 24*i* is pushed into the exterior part 24*o* by applying a further force, the bending part 26 opens and bends as shown in FIG. 5 (*b*). The cross-section of the bending part 26 increases toward the rear in the axial direction, and the bending part 26 elastically deforms like opening petals because it has notches 26*a* at the front end. When the interior part 24*i* comes into the exterior part 24*o* and their rear edges become set, the interior part 24*i* is fixed with a space 24*f*1 created between the top surface 24*f* and the inner surface of the exterior part 24*o*, and the assembly is completed. When the interior part 24*i* and the exterior part 24*o* are fixed to each other by concavo-convex fittings or with an adhesive, since the bending part 26 is provided in the space 24*f*1, even if there is a variation in size, it can be absorbed by the dimensions of the space 24*f*1 while rattling can be eliminated by the bending part 26. Thus, stable exterior quality can be obtained.

In particular, beneficial effect of airtightness is brought by the cap 24, which is equipped with a seal, while dimensional variation affects other qualities. Even if there is a dimensional variation, it can be addressed by the bending part 26. Accordingly, the rear ends of the interior part 24*i* and the exterior part 24*o* coincide with each other, the rear end of the cap 24 abuts the flange 12*a* without a gap to maintain air tightness with the cap when the cap 24 is fitted to the front barrel 12.

[Applying Part 10]

The applying part 10 is composed of a brush having multiple hairs.

The applying part 10 has a brush shape and can be a fine brush with an outside diameter of 2.0 mm or less. The brush of the applying part 10 may be either a natural fiber or an artificial fiber. In FIGS. 1 to 2, the applying part 10 is a bundle of resin fibers, has a tapered shape in which the front end portion is formed smaller toward the tip while the rear end portion is formed by thermal fusing into a flange shape (flange 10*a*) projecting radially outward so as to fix the fibers and not to come apart. In the rear end of the applying part 10, the application liquid is difficult to permeate into the surrounding flange 10*a* due to the packed fibers, whereas the central portion is formed so that it is easy for the application liquid to permeate between the fiber bundles. The relay core 14 abuts against the center of the applying part 10, so that the liquid can be fed from the liquid storage 16 through the relay core 14.

The material of the applying part 10 is not particularly limited, but it is preferable to use, for example, a synthetic resin fiber made of polyamide or polyester such as PBT (polybutylene terephthalate).

[Relay Core 14]

As shown in FIG. 5, the relay core 14 has a structure in which a recess is formed on the peripheral surface of the tip portion, and when the relay core 14 is fitted into the collector 18, an inward circumferential projection of the collector 18 fits into the recess to prevent the relay core from coming off. The relay core 14 is made of a fiber bundle made of a resin material, a molded core, or the like, and has a structure capable of feeding liquid by exerting capillary force.

The relay core 14 is preferably formed of a material that does not substantially contain formaldehyde, such as an olefin elastomer. That is because formalin may dissolve out from the relay core 14 of a material containing formaldehyde into the cosmetic liquid, which makes it unsuitable as a cosmetic tool. Further, as the material of the relay core 14, use of materials that do not contain acetal-based resin such as polyacetal, phenol resin, urea resin and melamine resin used for adhesives, is more preferable.

[Cosmetics]

The applicator according to the first embodiment is a liquid cosmetic applicator that uses an appropriate item such as a brush tip or a pen core as the applying part 10. The liquid cosmetic stored in the liquid storage 16 contains at least, carbon black, water, a dispersant composed of a film-forming resin in an amount of 0.5 to 5% by mass, a film-foaming agent in an amount of 2 to 15% by mass (in tams of solid content), and a surfactant in an amount of of 0.5% by weight or less, and has the viscosity measured by an ELD type viscometer at a temperature of 25° C. under a shear rate of 3.83S-1 set in the range of 2 to 8 mPa·s.

According to the embodiment, the resilient member is a spring, and (a) a part of the resilient member is double-wound to enhance the weight effect, (b) a single-wound tapered portion is provided in the place where the spring property is imparted so as to absorb dimensional variations between the inner barrel (liquid storage 16) and the outer barrel (rear barrel 20), (c) the wire in the part in contact with the endface of the outer barrel is folded to avoid formation of sharp points, and (d) the above is formed of a single wire.

Thus, the resilient member 22 can absorb the dimensional variation between the liquid storage 16 and the rear barrel 20 thanks to its elastic force. Therefore, the resilient member 22 can be realized at low cost while imparting not only the weighting effect but also the function of absorbing the dimensional variation between the members. As a result, improvement in workability can be achieved with reduction in cost.

Further, since the bending part 26 is provided in the space **24*f*1, even if there is a variation in the size, the variation can be absorbed by the dimensions of the space 24*f*1 and the bending part 26** can prevent rattling. Stable exterior quality can be obtained.

The above embodiment is one of embodiments of the present invention, and can be freely modified within the scope of the present invention.

INDUSTRIAL APPLICABILITY

The cosmetic applicator of the present invention can be used for a container of applying cosmetics as a facial cosmetic tool.

EXPLANATION OF SYMBOLS

10 applying part
**10*a*** flange
12 front barrel
**12*a*** flange
**12*b*** vent hole
14 relay core
16 liquid storage
18 collector
**18*a*** hollow hole
**18*b*** fin
**18*c*** slit
20 rear barrel
**20*a*** protrusion
**20*b*** void
**20*i*** interior part
**20*o*** exterior part
22 resilient member
**22*a*** inner winding portion
**22*a*1** tapered portion
**22*b*** outer winding portion
**22*c*** continuous portion
24 cap
**24*a*** inner cap
**24*b*** spring
**24*c*** engagement rib
**24*d*** projected portion
**24*e*** rear end portion
**24*f*** top surface
**24*f*1** space
**24*i*** interior part
**24*o*** exterior part
26 bending portion
D1 outside diameter
D2 outside diameter
D3 outside diameter

The invention claimed is:

1. A cosmetic applicator in which an applying part is provided at a front end of a barrel cylinder and a cosmetic is stored in a rear of the barrel cylinder, characterized in that the barrel cylinder has a double structure in which an exterior part is mounted on an outside of an interior part wherein the interior part and the exterior part form an outer barrel, and a resilient member is mounted to a rear end of a liquid storage of an inner barrel; wherein the resilient member is a spring and (a) a first part of the resilient member is double-wound to enhance a weight effect, (b) a single-wound tapered portion of the resilient member is provided in a place where a spring property is imparted so as to absorb dimensional variations between the inner barrel and the outer barrel, (c) the spring is formed of a single wire, and (d) a part of the single wire that is in contact with an endface of the outer barrel is folded to avoid formation of sharp points.

2. The cosmetic applicator according to claim 1, wherein the resilient member is made of metal.

3. The cosmetic applicator according to claim 1, wherein a void between an outside of the interior part and an inside of the exterior part is provided in a rear end of the outer barrel.

* * * * *